US005544510A

United States Patent [19]

Botteon et al.

[11] Patent Number: 5,544,510

[45] Date of Patent: Aug. 13, 1996

[54] KEY AND HOLDER COMBINATION

[75] Inventors: Renato Botteon, Vittorio Veneto; Ezio Chies, Colle Umberto, both of Italy

[73] Assignee: Silca S.P.A., Italy

[21] Appl. No.: 313,189

[22] PCT Filed: May 11, 1993

[86] PCT No.: PCT/EP93/01155

§ 371 Date: Oct. 12, 1994

§ 102(e) Date: Oct. 12, 1994

[87] PCT Pub. No.: WO93/22948

PCT Pub. Date: Nov. 25, 1993

[30] Foreign Application Priority Data

May 13, 1992 [IT] Italy ..... VE92A0018

[51] Int. Cl.[6] ..... A47G 29/10

[52] U.S. Cl. ..... 70/456 R; 70/459

[58] Field of Search ..... 292/456 R, 456 B, 292/457–459; 403/58, 57, 65

[56] References Cited

U.S. PATENT DOCUMENTS

| | | | |
|---|---|---|---|
| 2,291,896 | 8/1942 | Henderson | 70/456 R |
| 2,448,969 | 9/1948 | French | 70/456 R |
| 2,596,716 | 5/1952 | Otten | 70/456 R |
| 2,734,624 | 2/1956 | Kernicki | 70/456 R |
| 2,837,909 | 6/1958 | Ricci | 70/456 R |
| 2,964,937 | 12/1960 | Lautin | 70/456 R |
| 2,969,823 | 1/1961 | Sherwood | 70/456 R |
| 2,978,897 | 4/1961 | Capitani | 70/456 B |
| 3,004,422 | 11/1961 | Starrett | 70/456 R |
| 3,067,793 | 12/1962 | Collings | 70/456 B |
| 3,299,930 | 1/1967 | Schumer | 70/456 R |
| 3,318,354 | 5/1967 | Borisof | 70/457 |
| 3,407,636 | 10/1968 | Kovacevic . | |
| 3,677,044 | 7/1972 | De Frees . | |
| 3,813,907 | 6/1974 | Jones, Jr. et al. . | |
| 4,569,215 | 2/1986 | McCarthy | 70/456 R |
| 4,571,967 | 2/1986 | Jacobsen . | |
| 4,936,123 | 6/1990 | Matsuda | 70/459 |
| 4,939,917 | 7/1990 | Cartwright . | |
| 4,946,030 | 8/1990 | Guridi et al. . | |
| 4,951,489 | 8/1990 | Proch . | |
| 4,959,983 | 10/1990 | Hsu . | |
| 5,022,247 | 6/1991 | Beck | 70/458 |
| 5,046,343 | 9/1991 | Miwa . | |

FOREIGN PATENT DOCUMENTS

| | | | |
|---|---|---|---|
| 190778 | 8/1986 | European Pat. Off. | 70/456 R |
| 2597537 | 10/1987 | France . | |
| 3423704 | 1/1986 | Germany | 70/456 R |
| 3827536 | 11/1989 | Germany . | |
| 3926410 | 2/1991 | Germany | 70/456 R |
| 2249259 | 5/1992 | United Kingdom . | |

*Primary Examiner*—Steven N. Meyers
*Assistant Examiner*—Tuyet-Phllong Pham
*Attorney, Agent, or Firm*—Hoffman, Wasson & Gitler, P.C.

[57] ABSTRACT

A key and holder combination includes a holder provided with an impression for housing a key and with an articulated joint element for connecting the holder to the key. The joint is formed in two parts to provide the connection both when the key is housed in the impression and when the key is completely spaced therefrom. The articulated joint connects a corner of the head of the key with a corner of the holder, which has a base and a cover. The hinged and the base are provided with a device which is mutually snap enageable and the thickness of the corner part of the base to which the articulated joint element is applied corresponds to the overall thickness of the base plus the cover, the corresponding corner part of the cover being lacking.

24 Claims, 4 Drawing Sheets

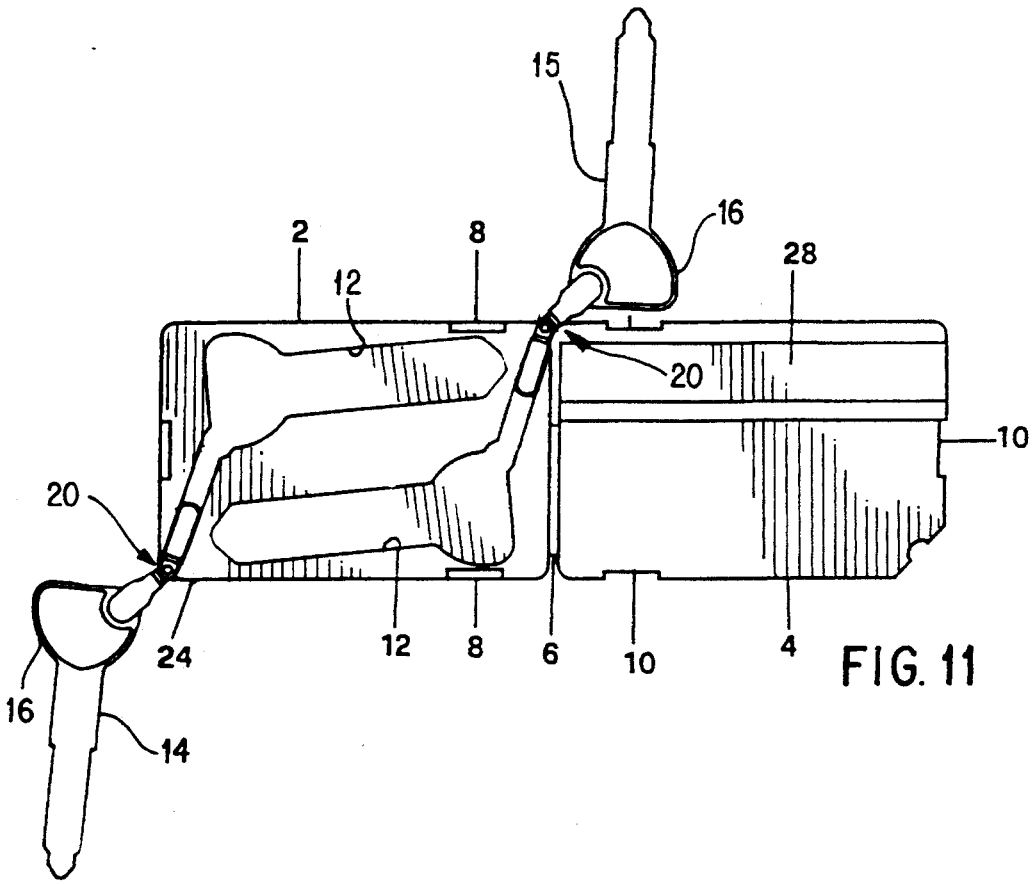
FIG. 11
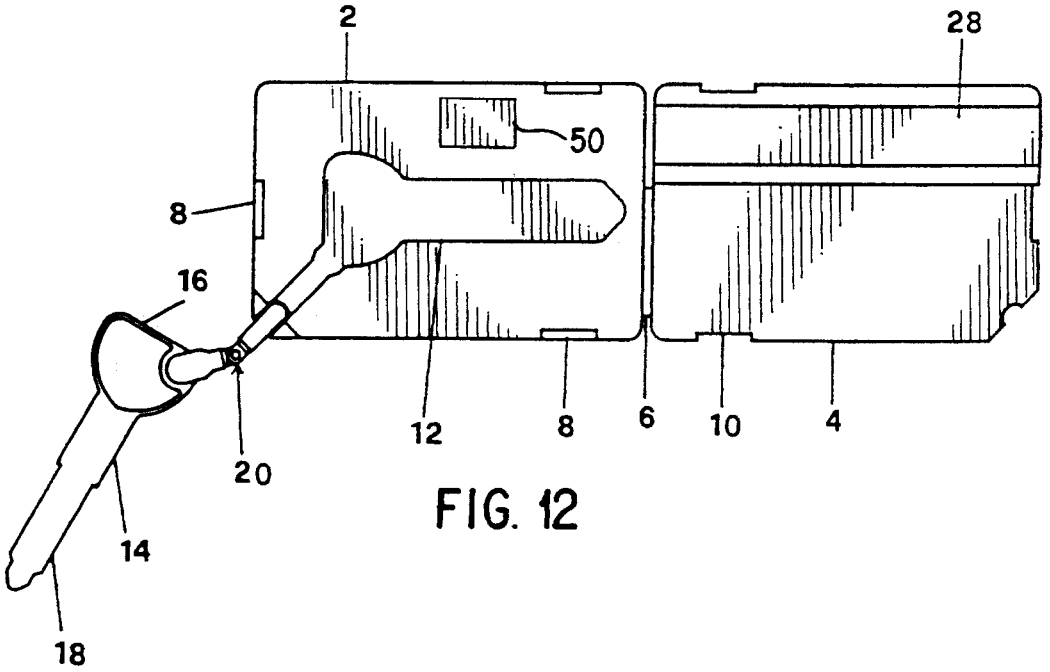
FIG. 12
FIG. 13
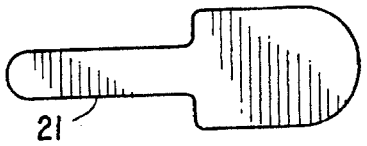

KEY AND HOLDER COMBINATION

FIELD OF THE INVENTION

This invention relates to a key and holder combination.

BACKGROUND OF THE INVENTION

Metal keys inserted into plastic holders in the standard form of credit cards are known. For this purpose the holder comprises an impression corresponding to the form of the key, which can be completely housed in said impression and be either permanently or releasably connected to it.

Generally if the key is of the releasable type a part of the impression which houses it is shaped in such a manner as to interfere with the head of the key in order to retain it, but to also enable it to be removed. This method is valid in terms of maneuverability of the key when separated from the card, but is less valid from the reliability aspect, as the key can be lost.

If however the key is permanently connected to the card this problem does not arise, but the key is then of poor maneuverability because when turned it also inevitably rotates the card or in any event is hindered by this latter in its movement.

DISCUSSION OF THE PRIOR ART

U.S. Pat. No. 5,046,343 discloses a key holder combination, comprising a holder shaped as a card and provided with an impression for housing the key. There are means for connecting the holder to the key, which consist of an articulated joint element, having three degrees of freedom, permanently connected to the holder and to the key and formed in at least two parts to provide the connection when the key is spaced from the holder.

SUMMARY OF THE INVENTION

The object of the invention is to provide a key with a holder in which on the one hand the key is permanently connected to the relative holder, and on the other hand can be operated without being in any way hindered by the holder.

This and further objects are achieved according to the invention through a key and holder combination, comprising a holder shaped as a card and provided with an impression for housing the key, and with an articulated joint element for connecting said holder to said key, said joint having three degrees of freedom and being formed in at least two parts to provide said connection both when the key is housed in said impression and when the key is completely spaced from said holder, characterised by the following features:

- the articulated joint connects a corner of the head of the key with a corner of the holder,
- the holder consists of a base and a cover hinged each other along a side and having, when superposed, the sizes of a usual credit card (85×54 mm),
- the cover and the base are provided with means which are mutually snap-engageable,
- the thickness of corner part of the base to which the articulated joint is applied corresponds to the overall thickness of the base plus the cover, the corresponding corner part of the cover being lacking.

BRIEF DESCRIPTION OF THE DRAWINGS

Some preferred embodiments of the present invention are described in greater detail hereinafter with reference to the accompanying drawings, in which:

FIG. 11 is a plan view of another embodiment of a combination according to the invention with the holder open and the keys extracted therefrom;

FIG. 12 is a plan view of another embodiment of the combination according to the invention with the holder open, the key extracted therefrom and a transmitter mounted thereon;

FIG. 13 is a plan view of a double-adhesive tape element used with the combination.

DESCRIPTION OF THE PREFERRED EMBODIMENTS

Figure 1:
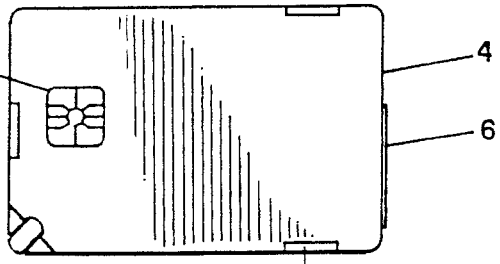
FIG. 1 is a plan view of a combination according to the invention with the holder closed and the key housed therein.

As can be seen from the figures, the combination according to the invention comprises a holder of plastic material and a key connected to said holder and constructed preferably of metal or high density polymer.

The holder comprises a substantially rectangular base 2 of standard dimensions corresponding to the dimensions of a usual credit card (85×54 mm). To this there is hinged along a smaller side a cover 4 of the same dimensions as the base and hence fitting perfectly over it. The hinge between the base and cover 4 is represented by a thinned part 6 of the actual plastic material from which both are formed, so that the entire assembly can be obtained by a single stage of injection moulding.

The base 2 is provided along those three sides not comprising the hinge 6 with projections 8 cooperating with notches 10 provided in the corresponding sides of the cover 4 to enable these two parts to be snap-locked together when superposed (holder closed).

The base 2 is provided with an impression 12 for housing a flat security key 14 comprising a head 16 and a shaft 18. Whereas the shaft 18 varies from key to key and hence the corresponding part of the impression 12 is of such a width and length as to be able to house practically any type of shaft, the head 16 is standardized for the various types of key and consequently the corresponding part of the impression 12 can be of a shape which is exactly complementary to said head and such as to allow the key 14 to be housed with a certain interference, so preventing the key from moving within its impression.

The combination according to the invention also comprises an element 20 for forming a stable connection between the key and base 2. This element consists of two short stems 22 each formed from two parts hinged together about the longitudinal axis of the stem. In addition one of the two parts of each stem is hinged to the adjacent part of the other stem about an axis perpendicular to the longitudinal axis of the stems. In this manner the connection element 20 forms overall an articulated joint, i.e. a connection which enables the key 14 to move in any direction relative to the base. This connection is made at a corner of the base 2, where a thickened part 24 is provided to further strengthen the connection region and to facilitate the articulated connection. In a position corresponding with this thickened part 24, the cover lacks the corresponding corner so that the overall thickness of the base plus cover is not increased by the presence of the thickened part.

The connection element 20 is connected to the base 2 of the holder by a small pin 26 which passes through them at the thicknened part 24.

As an alternative to the described articulated connection element 20 other embodiments are provided (not shown on the drawings) comprising a simple elastic bar, a chain, a connecting rod with two joints at its ends, and generally any other member which provides a permanent articulated connection between the key and the holder while at the same time allowing the key to be held spaced from the holder and be maneuvered without any limitation.

Parallel to its larger sides, the cover 4 also comprises a magnetic band 28 readable by usual magnetic card readers.

The combined key 14 and holder is advantageously used as an emergency key for a motor vehicle or house or any other requirement. For this purpose the key is cut to correspond to the lock with which it is to be used, and after being placed in its impression 12 in the base 2 of the holder it can be kept with the holder snap-closed (see FIG. 1), for example in a purse.

Figure 2:
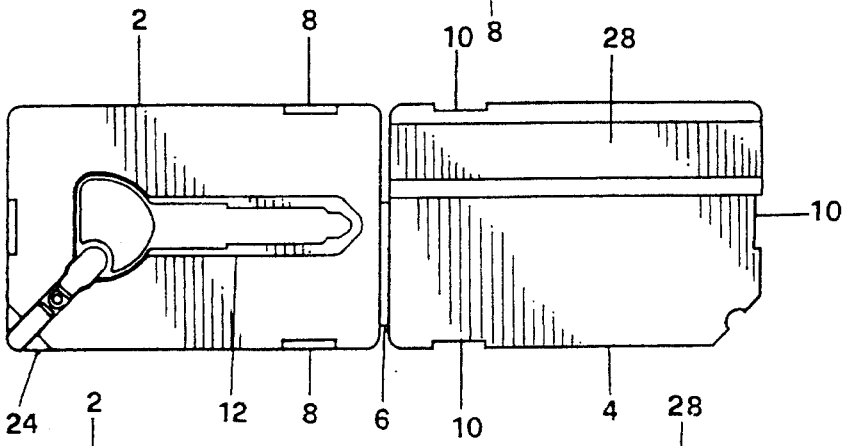
FIG. 2 is a plan view thereof with the holder open and the key housed therein.
Figure 3:
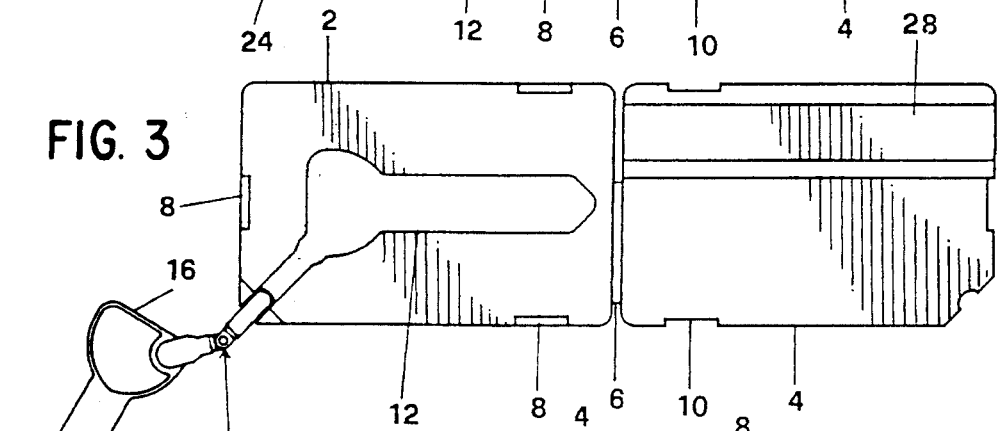
FIG. 3 is a plan view thereof with the holder open and the key extracted therefrom.
Figure 4:
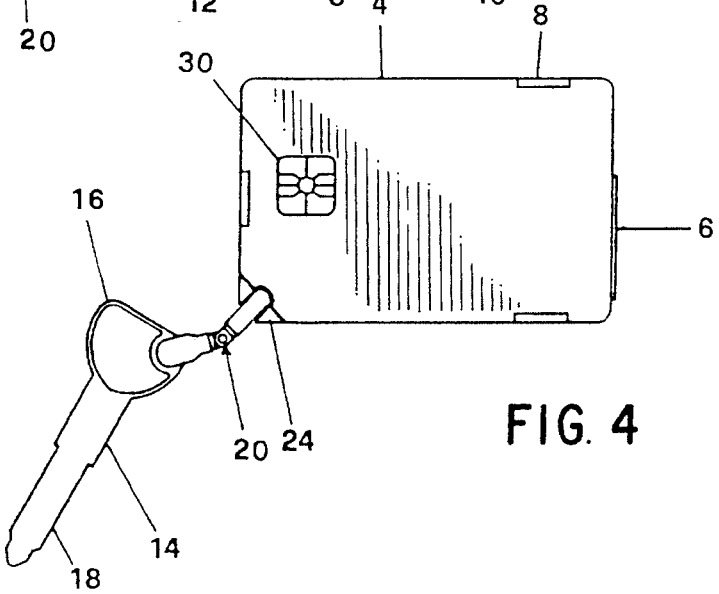
FIG. 4 is a plan view thereof with the holder closed and the key extracted therefrom.
Figure 5:
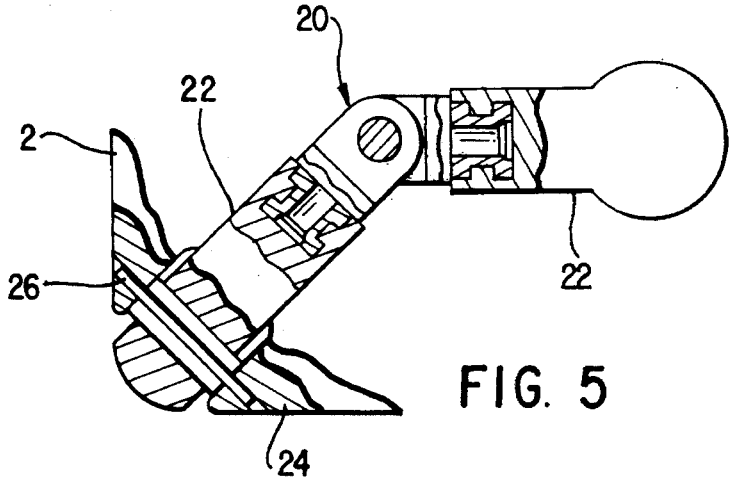
FIG. 5 is an enlarged longitudinal section through the element connecting the key to the holder.

When it is to be used, the holder is opened (see FIG. 2), the key 14 is extracted from its impression 12 (see FIG. 3) and the holder can again be snap-closed (see FIG. 4). The key can now be used, and can be turned without being in any way impeded in its movements by the holder, relative to which it can assume any position. After use, the holder is snap-closed, enabling it to be again placed in the purse.

The magnetic band can hold a series of data relative to the specification of the key 14 or personal data of the user. These data can be read by a normal magnetic card reader, either of sliding type or insertion type. The same or other data can also be printed in alphanumerical code or bar code on the base 2 of the holder or on the cover 4.

If it is required to memorize an amount of data greater than the capacity of the magnetic band 28, the cover 4 can be provided with a programmable memory 30 of conventional type, illustrated for example in FIGS. 1 and 4.

Figure 6:
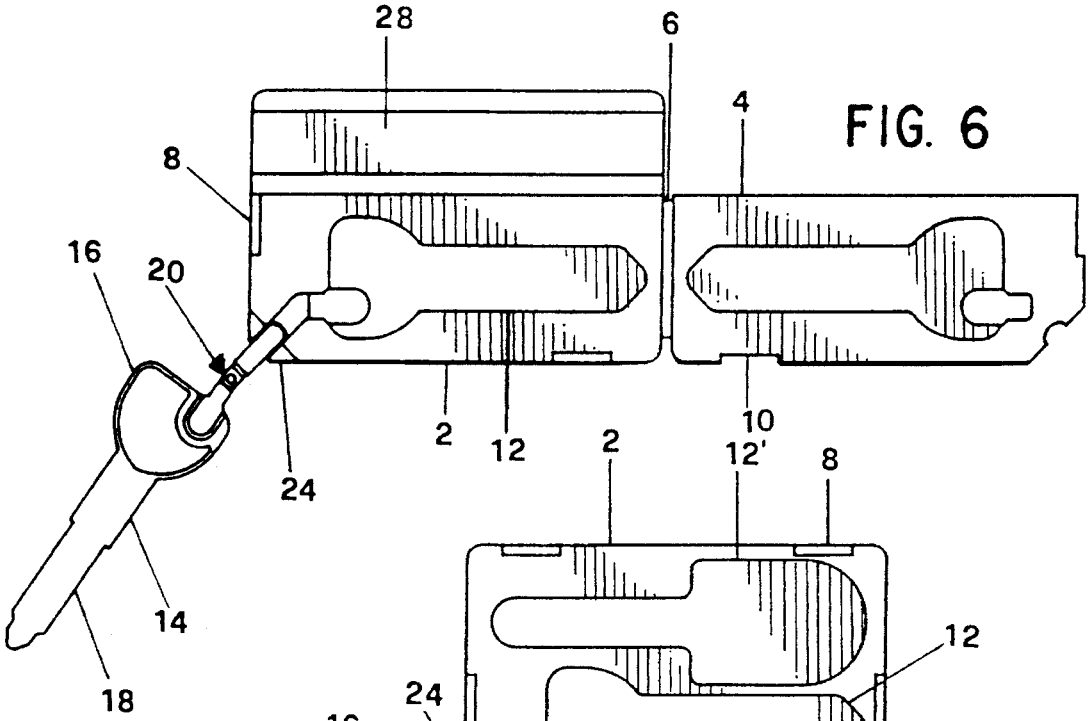
FIG. 6 shows a second embodiment of the combination according to the invention in the same view as FIG. 3.

FIG. 6 shows a different embodiment of the holder, in which the cover 4 is of smaller dimensions than the base 2, and specifically is narrower. In this case it is preferable for the magnetic band 28, if provided, to be included on the base 2, which for this purpose comprises a thin band beyond that part of the base 2 carrying the impression 12 for housing the key 14.

Figure 7:
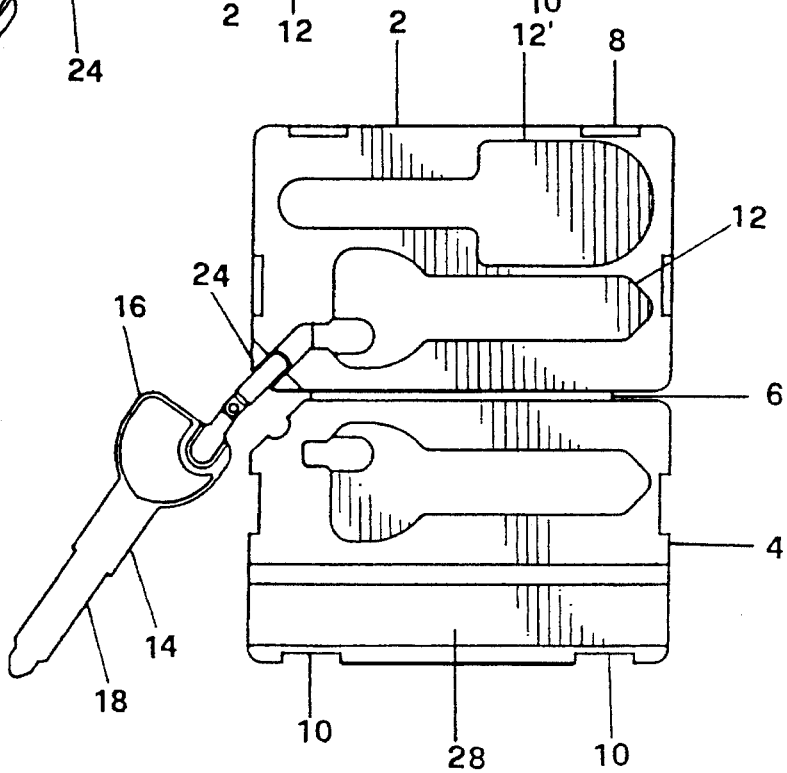
FIG. 7 shows a third embodiment thereof in the same view as FIG. 3.

FIG. 7 shows a different embodiment of the holder, in which the cover 4 is hinged to the base 2 along a larger rather than a smaller side, the base 2 also comprising a second impression 12' for housing a second key 15 of different type from the preceding but not connected to the base. This second key could however also be connected to the base 2 by an articulated element as shown on FIG. 11 analogous to the element 20, or by other systems such as a piece of double-adhesive tape 21, as shown on FIG. 13, or a pocket formed in the position of the impression 12' relative to the key shaft, for example with a band of transparent plastic material.

Figure 8:
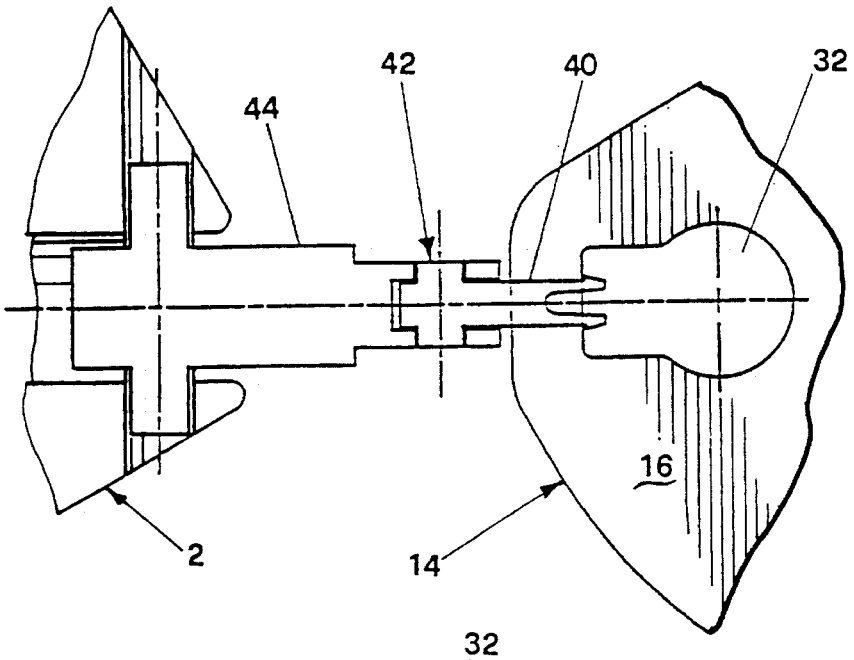
FIG. 8 shows the enlarged particular of a further embodiment of the element connecting the key to the holder.
Figure 9:
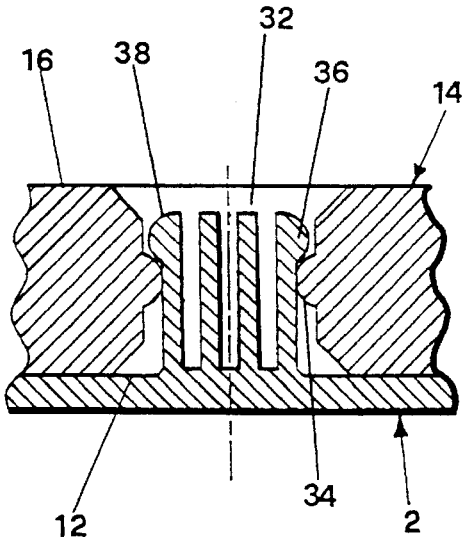
FIG. 9 shows the engagement of the key with the holder.

FIGS. 8 and 9 show a further embodiment which foresees that the engagement between the key 14 and the holder is obtained by providing the head 16 of the key with a seat formed by a circular hole 32 having the inner surface provided with a circumferential rib 34. This rib cooperates with the projecting edge 36 of a little peg 38 integral with the bottom of the impression 12 foreseen in the base 2 and elastically shrinkable in radial way.

Near the seat the key is axially pierced to receive, through snap engagement, a complementary arm 40 of a cross piece 42 articulated to a member 44, around an axis orthogonal to the axis of said arm 40. In its turn the member 44 is articulated at a corner of the base 2 of the holder as described in the above embodiments.

It is clear that also in this case the widest possibilities of movement of the key 14 are ensured once it has been taken away from the holder and at the same time the firm connection of the key is ensured in its impression in the holder. Furthermore this embodiment seems to be more advantageous than the previous one both for the simple constructional realization of the articulation joint and for the possibility not to correlate the shape of the impression 12 the key and the shape of the same key.

Figure 10:
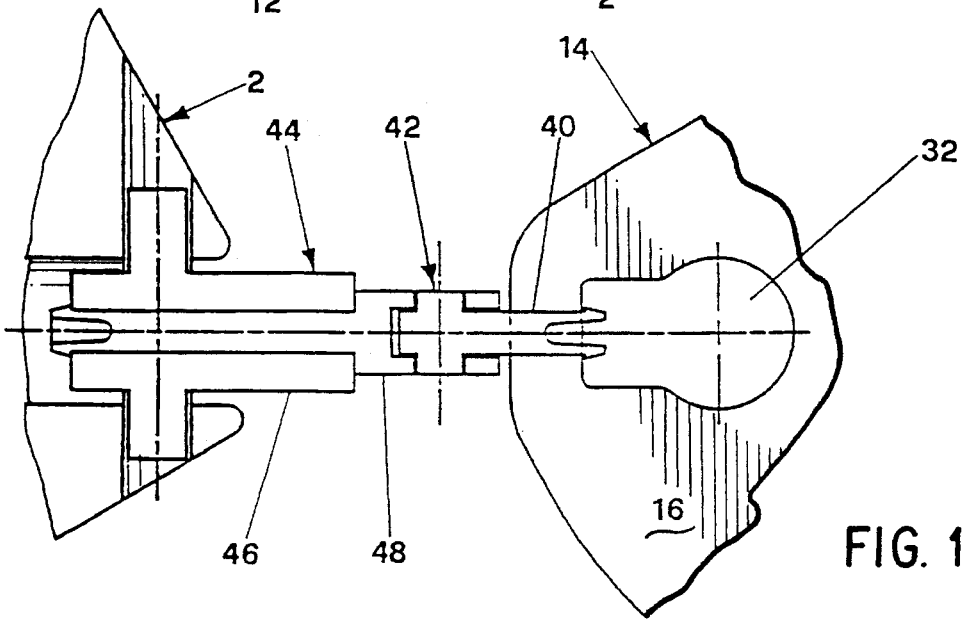
FIG. 10 shows a further embodiment of the element connecting the key to the holder.

In order to ensure a wider possibility of movement between key and holder (FIG. 10) it is foreseen that the member 44 consists of two separate portions, that is a cross piece 46, articulated to the holder, and an intermediate element 48 which on one hand supports the cross piece 42 and on the other hand is elastically snap engageable with the cross piece 46 and may rotate with respect to it.

Both the embodiments above described present the further advantage of enabling the snap engagement of the key with the holder after the cut has been carried out thus making easier the operation.

The invention also foresees other embodiments (not shown) which may be considered technical equivalents, according to which the head of the key is provided with a peg snap engageable inside a corresponding passing hole provided in the bottom of the impression. In this case it is also possible to use the end of the peg an expulsive member of the key from its impression, through simple pressure on it by the user.

In all the aforedescribed embodiments the base 2, which is of greater thickness as it has to contain the key 14, is externally convex to a certain extent, so that its edges are thinner than the centre. This convexing facilitates the insertion of the closed holder into a purse.

Within the depth of the base there can also be housed a transmitter or receiver-transmitter circuit 50, as shown on FIG. 12, for use for radio control purposes.

We claim:

1. A key and holder combination, comprising a holder shaped as a card having an impression for housing a key, and an articulated joint element for connecting said holder to said key, said joint element having three degrees of freedom and being formed in at least two parts to provide said connection both when said key is housed in said impression and when said key is completely spaced from said holder, wherein said articulated joint element connects a corner of a head of said key with a corner of said holder, said holder comprises a base and a cover hinged to each other along a side and having, when superposed, sizes of a usual credit card (85×54 mm), said cover and said base are provided with means which are mutually snap-engageable, and a thickness of a corner part of said base to which said articulated joint element is applied corresponds to an overall thickness of said base plus said cover;

wherein said head of the key is provided with a seat into which an appendix snap engages being integral with a bottom of the impression;

wherein the appendix consists of a radially shrinkable peg cooperating with a circumferential rib foreseen in said seat;

wherein said key is axially pierced to snap engage an arm of a cross piece articulated to a portion around an axis orthogonal to an axis of said arm, and portion being articulated to said holder;

wherein said portion consists of two different parts, respectively a cross piece articulated to said holder and an intermediate element supporting said cross piece and elastically snap engaging with said cross piece.

2. A combination as claimed in claim 1, wherein said snap engageable means comprises projections and notches.

3. A combination as claimed in claim 1, wherein a hinge between said base and said cover is a thinned part of an actual plastic material from which said base and said cover are formed.

4. A combination as claimed in claim 1, wherein said cover is hinged to said base along one of their larger sides.

5. A combination as claimed in claim 1, wherein said cover is hinged to said base along one of their smaller sides.

6. A combination as claimed in claim 1, wherein said impression has a depth less than a thickness of said base.

7. A combination as claimed in claim 1, wherein an impression part relative to said head of the key is complementary to a shape of said head, whereas said impression part corresponding to a shaft of the key is larger than said shaft.

8. A combination as claimed in claim 1, wherein said articulated joint element comprises two short stems hinged about their longitudinal axis to said head of said key and to said holder, and hinged to each other about an axis perpendicular to their longitudinal axis.

9. A combination as claimed in claim 1, wherein said articulated joint element comprises two short stems each formed from two parts hinged together about the said longitudinal axis of the relative stem, one of the two parts of each stem being hinged to the corresponding part of the other stem about an axis perpendicular to said longitudinal axis of said stems.

10. A combination as claimed in claim 9, wherein one of said two stems is hinged to said holder by a pin inserted through a constituent plastic material of said holder in proximity to a corner thereof.

11. A combination as claimed in claim 10, wherein said pin is positioned in a thickened part of a constituent plastic material of the holder.

12. A combination as claimed in claim 1, wherein said holder is provided with a magnetic band.

13. A combination as claimed in claim 12, wherein said magnetic band is provided on a thinned part of the holder.

14. A combination as claimed in claim 12, wherein said magnetic band is provided in said holder cover.

15. A combination as claimed in claim 1, further comprising a programmable memory incorporated into a plastic material of said holder.

16. A combination as claimed in claim 1, wherein said holder further comprises a region carrying in coded form data relative to a specification of the key.

17. A combination as claimed in claim 1, wherein an impression for a second key is provided in said base of said holder.

18. A combination as claimed in claim 17, wherein said second key to be housed in said impression for a second key is permanently connected to said base by a separate articulated connection member.

19. A combination as claimed in claim 17, wherein said second key is connected to said impression for a second key by double-adhesive tape.

20. A combination as claimed in claim 17, wherein a pocket portion is provided in said second impression for insertion of the second key.

21. A combination as claimed in claim 1, wherein said cover is of smaller width than said base.

22. A combination as claimed in claim 21, wherein part of said base not covered by said cover is thinned and carries said magnetic band.

23. A combination as claimed in claim 1, wherein said holder when closed is slightly convex thereby having thinned edges.

24. A combination as claimed in claim 1, wherein said holder houses a transmitter circuit for radio control purposes.

* * * * *